US010589561B2

(12) United States Patent
Bez et al.

(10) Patent No.: US 10,589,561 B2
(45) Date of Patent: Mar. 17, 2020

(54) WRITING INSTRUMENT HAVING A MULTI-USE TIP

(71) Applicant: SOCIETE BIC, Clichy (FR)

(72) Inventors: Arnaud Bez, Garches (FR); Olivier Albenge, Outreau (FR)

(73) Assignee: SOCIETE BIC, Clichy (FR)

( * ) Notice: Subject to any disclaimer, the term of this patent is extended or adjusted under 35 U.S.C. 154(b) by 42 days.

(21) Appl. No.: 15/738,851

(22) PCT Filed: Jun. 15, 2016

(86) PCT No.: PCT/FR2016/051450
§ 371 (c)(1),
(2) Date: Dec. 21, 2017

(87) PCT Pub. No.: WO2016/207518
PCT Pub. Date: Dec. 29, 2016

(65) Prior Publication Data

US 2018/0186171 A1 Jul. 5, 2018

(30) Foreign Application Priority Data

Jun. 24, 2015 (FR) ..... 15 55813

(51) Int. Cl.
*B43K 1/00* (2006.01)
*B43K 8/02* (2006.01)

(52) U.S. Cl.
CPC ..... *B43K 1/006* (2013.01); *B43K 1/003* (2013.01); *B43K 8/02* (2013.01)

(58) Field of Classification Search
CPC ..... B43K 1/006; B43K 1/003; B43K 8/02; B43K 1/02; B43K 1/04; B43K 1/06; B43K 1/12; B43K 8/022; B43K 8/024; B43K 8/026
See application file for complete search history.

(56) References Cited

U.S. PATENT DOCUMENTS

| | | | | |
|---|---|---|---|---|
| 2,453,201 A | | 11/1948 | Cushman | |
| 4,043,682 A | * | 8/1977 | McDaniel | B43K 1/12 401/199 |
| 4,723,859 A | | 2/1988 | Kitoh | |
| 5,642,667 A | * | 7/1997 | Sastre | B41K 1/00 101/405 |
| 5,820,285 A | * | 10/1998 | Ikeda | B43K 1/00 401/199 |

(Continued)

FOREIGN PATENT DOCUMENTS

| | | |
|---|---|---|
| CN | 201165115 | 12/2008 |
| CN | 201390042 | 1/2010 |

(Continued)

OTHER PUBLICATIONS

International Search Report dated Sep. 12, 2016 from corresponding International PCT Application PCT/FR2016/051450, 3 pages.

*Primary Examiner* — David J Walczak
(74) *Attorney, Agent, or Firm* — Ohlandt, Greeley, Ruggiero & Perle, L.L.P.

(57) ABSTRACT

A writing instrument having a body and a writing tip that is mounted on the body. The body and the writing tip extend along an axial direction, and the writing tip presents a distal end portion having a cross-section that is U-shaped.

9 Claims, 2 Drawing Sheets

(56) References Cited

U.S. PATENT DOCUMENTS

| | | | |
|---|---|---|---|
| 6,280,109 | B1 | 8/2001 | Serratore |
| 7,320,553 | B1 | 1/2008 | Nunez |
| D669,536 | S | 10/2012 | Hung |
| 8,303,202 | B1 | 11/2012 | Garcia |
| D711,471 | S | 8/2014 | Morimoto |
| 2009/0317172 | A1 | 12/2009 | Bedhome et al. |
| 2013/0051895 | A1 | 2/2013 | Chou |

FOREIGN PATENT DOCUMENTS

| | | | |
|---|---|---|---|
| CN | 202378490 | | 8/2012 |
| CN | 202399696 | | 8/2012 |
| CN | 202498869 | | 10/2012 |
| DE | 202010006335 | U1 | 8/2010 |
| EP | 0747240 | | 12/1996 |
| FR | 2899841 | | 10/2007 |
| JP | 9-207486 | | 8/1997 |
| JP | 2003011577 | | 1/2003 |
| JP | 2006-198891 | | 8/2006 |
| JP | 3150079 | | 4/2009 |
| JP | 3176092 | | 6/2012 |
| KR | 20-2013-0000576 | | 1/2013 |
| KR | 10-2014-0133006 | | 11/2014 |
| WO | 2007116141 | A1 | 10/2007 |

* cited by examiner

WRITING INSTRUMENT HAVING A MULTI-USE TIP

DOMAIN OF THE INVENTION

The present application relates to the field of writing instruments, and more particularly to writing instruments providing a plurality of writing options with a single tip, or having a multi-use tip.

STATE OF THE PRIOR ART

Numerous writing instruments are known. However, no known writing instrument presents a single tip that is robust and simple to manufacture, and that presents a plurality of different writing options. A need thus exists in this regard.

PRESENTATION OF THE INVENTION

An embodiment provides a writing instrument comprising a body and a writing tip that is mounted on the body, the body and the writing tip extending along an axial direction, the writing tip presenting a distal end portion having a cross-section that is U-shaped.

It should be understood that a distal end portion is a portion of the tip that extends from the distal end of the writing tip (i.e. the distal writing end) over all or some of the visible portion of the tip when the tip is mounted on the body.

It should thus be understood that the distal end portion presents the general shape of a section member of cross-section (i.e. of section perpendicular to the axial direction) that is U-shaped, which section might naturally change along the axial direction, while conserving a general U-shape. In other words, the distal end portion of the writing tip is substantially in the shape of a parallelepiped, presenting a groove in one of its side faces, said groove opening out onto the distal end of the writing tip.

The U-shape makes it possible to form a plurality of portions that can be used for writing, which portions may be of different dimensions, making a plurality of line widths possible, while being robust and simple to manufacture. In addition, the top portion of the U-shape (i.e. the distal ends of the vertical bars of the U-shape) makes it possible to write by forming two parallel lines (i.e. a "double" line). In other words, the shape of the section of the distal end portion is strictly U-shaped and does not present any concave shape that provides a certain geometrical property to the line that the user can form by means of the tip, other than the concave shape of the U-shape.

In some embodiments, the distal end portion includes a distal writing end, the outer periphery of the U-shape of the distal writing end forming a plurality of writing edges.

It should thus be understood that except for the inside outline of the U-shape (i.e. the edges of the concave shape of the U-shape), each of the edges forming the periphery of the U-shape forms a writing edge, i.e. an edge via which the user can write. The tip thus forms three simple writing edges (the outer bottom face of the U-shape and the two outer side faces of the U-shape), and an edge for "double" writing (the two outer top faces of the vertical bars of the U-shape).

Such a tip thus offers the user numerous writing options, while being robust and simple to make. In addition, as a result of the writing portions being formed by edges, writing accuracy is improved.

In some embodiments, the distal end portion includes a distal end face that extends substantially transversally to the axial direction, while each writing edge is formed by a rounded chamfer that is formed on a portion of the periphery of the distal end face. Such chamfers are robust and simple to manufacture, and produce numerous options in use.

The term "substantially transversally" means that the distal end face forms an angle with the axial direction that lies in the range 60° to 90°. It should be understood that the writing tip is configured so that the user writes with the chamfered edges and not with the distal end face. Such chamfered edges are simple to manufacture, while providing great writing accuracy. For example, the shapes of the chamfers result from the molding of the writing tip, i.e. after molding, no machining is necessary to obtain the chamfers.

In some embodiments, the shape of the cross-section of the distal end portion (i.e. the U-shape) presents an axial plane of symmetry.

In particular, it is thus ensured that the two vertical bars of the U-shape are similar. This leads to great ease of use, greater versatility, further facilitates fabrication, and improves robustness. In particular, such symmetry provides the same comfort in use both for right-handed and for left-handed users.

In some embodiments, the outer face of the portion of the distal end portion forming the bottom horizontal bar of the U-shape slopes relative to the axial direction.

For example, the face is plane. Such a slope forms a clearance that provides a certain amount of comfort in use, while being simple to manufacture and guaranteeing the robustness of the tip.

In some embodiments, the writing tip presents a distal writing end, and the inside face of the portion of the distal end portion, forming the bottom horizontal bar of the U-shape, curves along the axial direction in the vicinity of the distal writing end, and follows a profile of the conical type having a radius that varies along the axial direction.

The term "in the vicinity of the distal writing end" means the portion of the distal end portion that is adjacent to the distal writing end.

For example, the profile satisfies the equation:

$$(x/a)^2+(y/b)^2=1 \quad (1)$$

where:

- x: represents the abscissa value along the axial direction;
- y: represents the ordinate value along the thickness direction of the horizontal bar of the U-shape;
- a: is a positive real number;
- b: is a positive real number that lies in the range 0.2×a to 0.8×a (i.e. 0.2 multiplied by a to 0.8 multiplied by a).

It should thus be understood that the distal end portion presents such a profile from the distal end of the tip, and may possibly present a profile of some other shape along the axial direction beyond this curved profile, going towards the proximal end of the tip, but not necessarily. For example, the other profile may be constant along the axial direction.

Such a profile of conical type makes it possible to ensure that, in the axial direction, the cavity of the U-shape is minimized over the majority of the axial end portion, and is at its maximum at the distal end itself, with this varying in non-linear manner along the axial direction. This makes it possible to provide a setback formed by the inside cavity of the U-shape that is sufficient to procure sufficient comfort in use, in particular when the user uses the top portion of the U-shape, while providing sufficient stiffness, as a result of the thickness of material, so that it deforms not at all or only in acceptable manner. This profile is thus easy to manufacture, and provides a degree of robustness at the tip.

In some embodiments, the distal end portion comprises a distal end face, the thickness of each of the bars forming the U-shape of the distal end face lies in the range 0.5 mm (millimeters) to 1.0 mm (millimeters).

It should thus be understood that each of the bars of the U-shape of the distal end face presents such a thickness. Such thickness makes it possible to guarantee the stiffness and the mechanical strength of the tip when the user presses on it in order to write, while being easy to manufacture.

In some embodiments, the writing tip is made of sintered powder.

For example, the powder is a powder of plastics material such as polyethylene (also known under the acronym "PE"). Such a material, and its method of working by sintering, is particularly suitable for mass production of such a writing tip, which tip is thus robust and easy to manufacture.

In some embodiments, the writing instrument forms a highlighter.

Such a writing instrument is particularly suitable for forming a highlighter.

BRIEF DESCRIPTION OF THE DRAWINGS

The invention and its advantages can be better understood on reading the following detailed description of embodiments of the invention given as non-limiting examples. The description makes reference to the sheets of accompanying figures, in which.

DETAILED DESCRIPTION OF EMBODIMENTS

Figure 1:
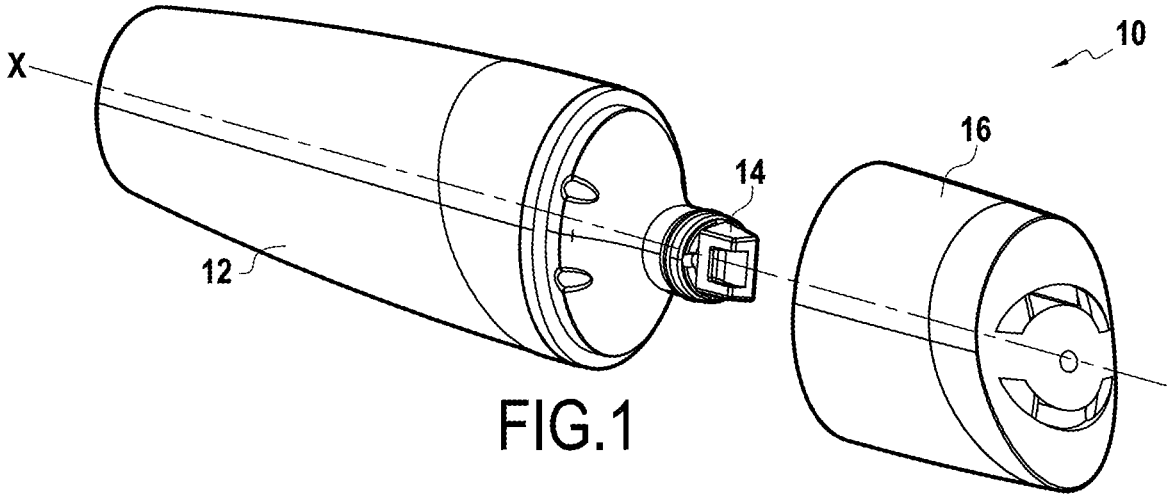
FIG. 1 is a perspective view showing a highlighter.

An embodiment of the invention is described with reference to FIGS. 1 to 5. FIG. 1 shows a writing instrument 10, in this embodiment a highlighter 10, comprising a body 12, a writing tip 14, and a cap 16. The writing instrument 10, and more particularly the body 12 and the writing tip 14 extend along an axial direction X.

The writing tip 14 has a distal writing end 14A and a proximal end 14B. The proximal end 14B is put into fluid flow contact with an ink reservoir (not shown) that is arranged within the body 12, so as to supply the writing tip 14 with ink. More particularly, the writing tip 14 includes a portion 15A that can be seen when the tip 14 is mounted on the body 12, and a portion 15B that is used to mount it on the body 12.

The portion 15A includes a proximal face 15AA that forms a shoulder that is configured to bear against the body 12. The shoulder serves in particular to block the tip 14 in such a manner that the portion 15A remains outside the body 12 while the writing tip 14 is being used.

Figure 2:
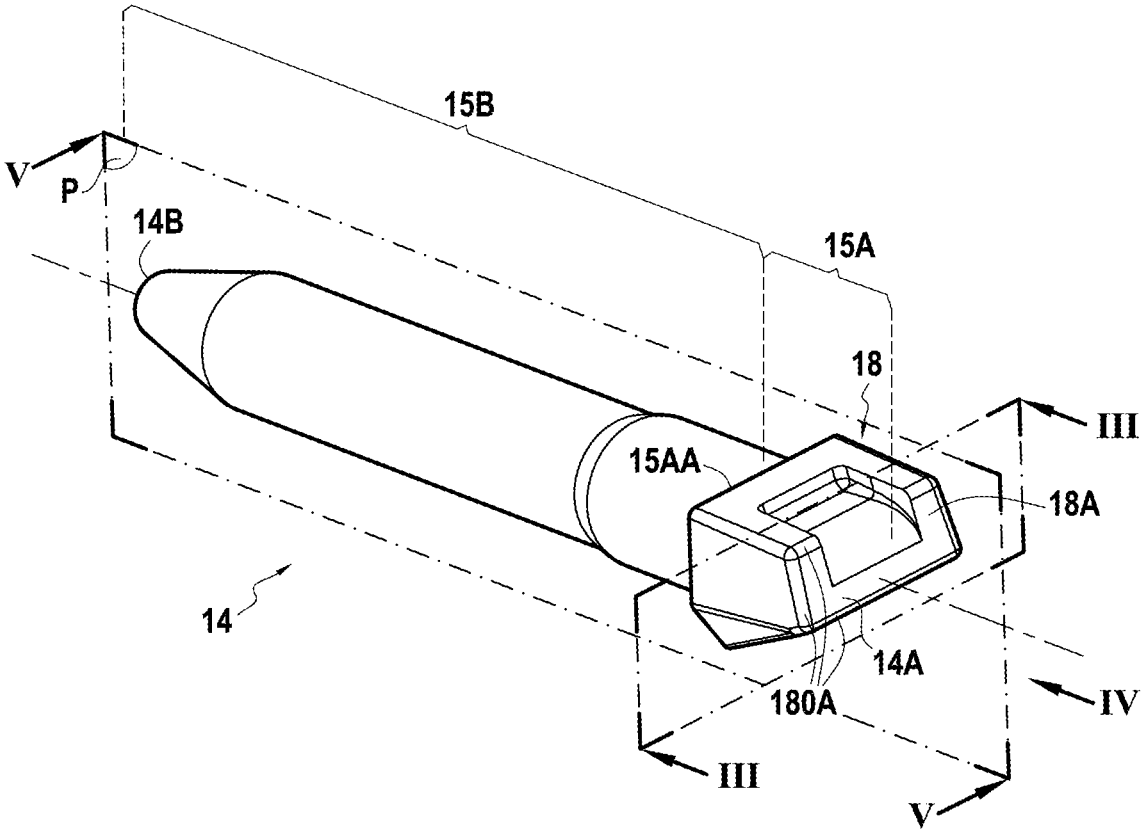
FIG. 2 is a perspective view showing the tip of the FIG. 1 highlighter.
Figure 3:
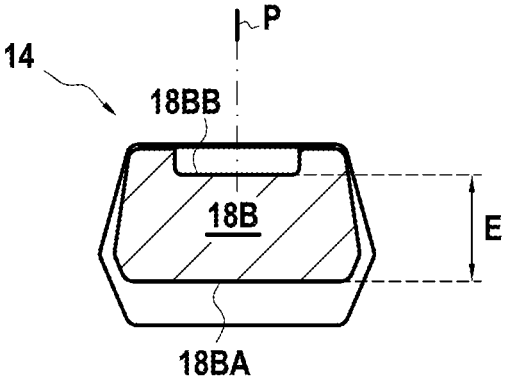
FIG. 3 is a view showing the distal end portion of the FIG. 2 writing tip, in cross-section on plane III.
Figure 4:
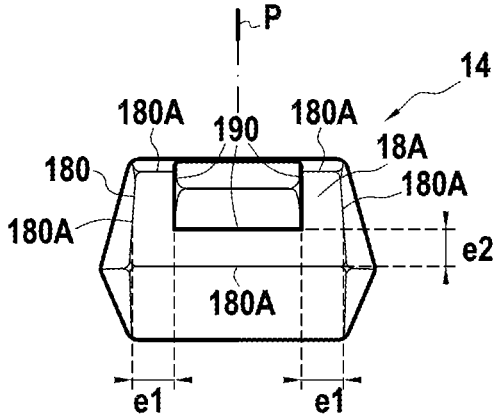
FIG. 4 shows the FIG. 2 writing tip, as seen looking along arrow IV in FIG. 2.

The writing tip 14 includes a distal end portion 18 that extends along the axial direction over about 75% of the length of the portion 15A. As shown in FIGS. 2 and 3, the cross-section of the distal end portion 18 is U-shaped. The distal end portion 18 and more generally, in this embodiment, the entire writing tip 14, presents an axial plane of symmetry P.

The distal end portion 18 includes the distal writing end 14A that, in this embodiment, forms a distal end face 18A. The distal end face 18A includes an inside periphery 190 and an outside periphery 180 of U-shape. In general, and unless indicated to the contrary, the adjectives "inside" and "outside" should be understood relative to the cavity of the U-shape, i.e. inside the cavity of the U-shape or outside the cavity of the U-shape. The outside periphery 180 of the U-shape of the distal end 14A forms a plurality of writing edges 180A. In this embodiment, the writing edges 180A are formed by rounded chamfers formed on the periphery of the distal end face 18A.

The distal end face 18A naturally presents a U-shape. The thickness e1 of the vertical bars of the U-shape of the distal end face 18A lies in the range 0.5 mm to 1.0 mm. The thickness e2 of the horizontal bar of the U-shape of the distal end face 18A also lies in the range 0.5 mm to 1.0 mm. In this embodiment, e1 is equal to 0.81 mm, while e2 is equal to 0.75 mm. In general, in order to guarantee that the tip has good mechanical strength, the more e2 is small, the more e1 must be large. The inventors have observed that the following relationship makes it possible to manufacture tips that are satisfactory with regard to their mechanical strength:

$$e2 \leq e1 \leq 2 \times e2 \quad (2)$$

Figure 5:
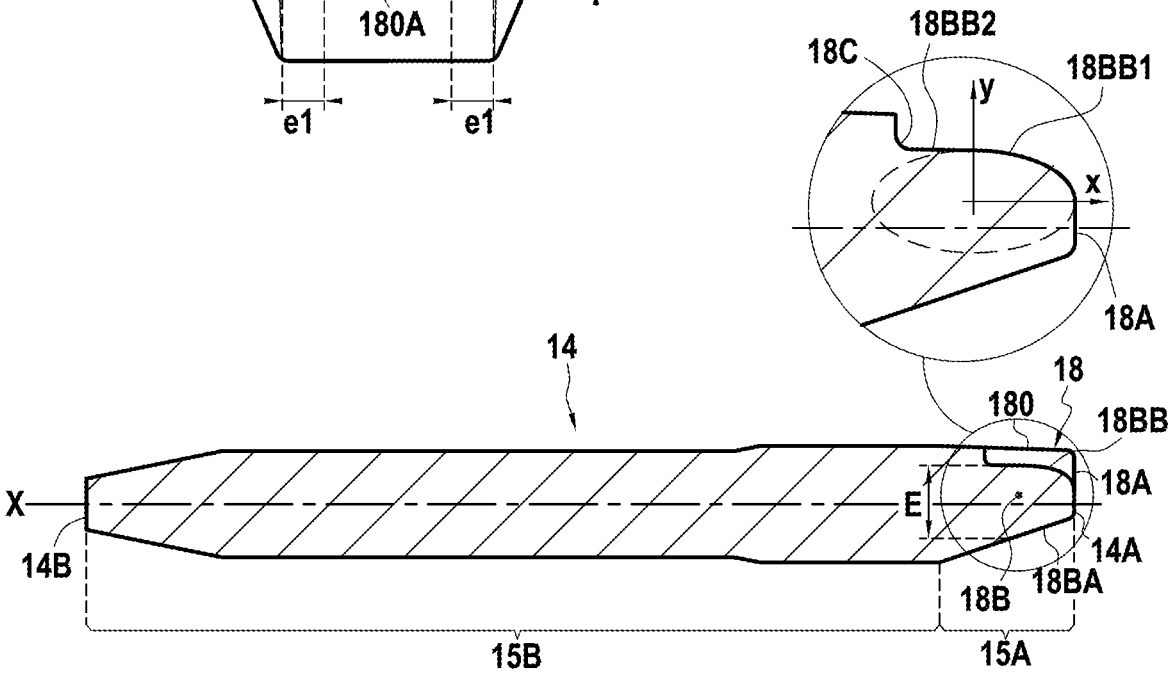
FIG. 5 is a view showing the FIG. 2 writing tip, in axial section on plane V.

As shown in FIG. 5, the portion 18B of the distal end portion 18 that forms the bottom horizontal bar of the U-shape presents an outside face 18BA that slopes relative to the axial direction X. Naturally, and in general, the slope of the outside face 18BA is such that the thickness E of the portion 18B decreases going towards the distal end 14A (i.e. along the direction going from the proximal end 14B to the distal end 14A).

The portion 18B presents an inside face 18BB that curves along the axial direction X in the vicinity of the distal end 14A, and follows a profile of conical type having a radius that varies along the axial direction X from the distal end 14A. Naturally, and in general, in the vicinity of the distal end 14A, the curve of the inside face 18BB is such that the thickness E of the portion 18B decreases going towards the distal end 14A (i.e. along the direction going from the proximal end 14B to the distal end 14A).

In this embodiment, the conical profile having a radius that varies along the axial direction is defined by the equation:

$$(x/2)^2+(y)^2=1 \quad (3)$$

where:

x: represents the abscissa value along the axial direction; and y: represents the ordinate value along the thickness direction E of the horizontal bar of the U-shape;

The ellipse defined by equation (3) is shown by dashed lines in the detail view of FIG. 5, together with the x- and y-coordinate axes, the center of the ellipse naturally corresponding to the origin of the (x, y) coordinates.

Thus, in this embodiment, the inside face 18BB presents both a distal portion 18BB1 that, along the axial direction X, presents a profile of the conical type having a radius that varies along the axial direction X that satisfies equation (3), and also a proximal portion 18BB2 that, along the axial direction X, presents a rectilinear constant profile that is connected in continuous manner to the profile of the conical type. In this embodiment, a fillet 18C connects the inside face 18BB to the remainder of the wall of the tip, while guaranteeing geometrical continuity along the axial direction X. The conical type curved profile of the distal portion 18BB1 is also connected in continuous manner to the distal end face 18A.

In this embodiment, the writing tip 14 is made of sintered powder. In this embodiment, the powder is polyethylene.

Naturally, other materials and/or other methods of manufacture (other than sintering) may also be used to manufacture the writing tip 14.

Although the present invention is described with reference to specific embodiments, modifications and changes may naturally be applied to them without going beyond the general ambit of the invention as defined by the claims. In particular, individual characteristics of the various embodiments shown and mentioned may be combined in additional embodiments. Consequently, the description and the drawings should be considered in a sense that is illustrative rather than restrictive.

The invention claimed is:

1. A writing instrument comprising a body and a writing tip that is mounted on the body, the body and the writing tip extending along an axial direction, the writing tip presenting a distal end portion having a cross-section perpendicular to the axial direction having a U-shape, wherein the distal end portion has a portion with an outer face forming a bottom horizontal bar of the U-shape that slopes relative to the axial direction.

2. The writing instrument according to claim 1, wherein the outer face forms a plurality of writing edges.

3. The writing instrument according to claim 2, wherein each one of the plurality of writing edges is formed by a rounded chamfer that is formed on a portion of a periphery of the outer face.

4. The writing instrument according to claim 1, wherein the cross-section of the distal end portion has a shape that presents an axial plane of symmetry.

5. The writing instrument according to claim 1, wherein the U-shape includes two vertical bars connected by the bottom horizontal bar, each of the two vertical bars having a thickness in the range of 0.5 mm to 1.0 mm.

6. The writing instrument according to claim 1, wherein the writing tip is made of sintered powder.

7. The writing instrument according to claim 1, wherein the writing instrument is a highlighter.

8. A writing instrument comprising a body and a writing tip that is mounted on the body, the body and the writing tip extending along an axial direction, the writing tip presenting a distal end portion having a cross-section perpendicular to the axial direction having a U-shape, wherein the distal end portion includes a distal writing end, and an outer periphery of the U-shape of the distal writing end forming a plurality of writing edges, and wherein the distal end portion includes a distal end face that extends substantially transversally to the axial direction, while each writing edge is formed by a rounded chamfer that is formed on a portion of a periphery of the distal end face.

9. A writing instrument comprising a body and a writing tip that is mounted on the body, the body and the writing tip extending along an axial direction, the writing tip presenting a distal end portion having a cross-section perpendicular to the axial direction having a U-shape, wherein the writing tip presents a distal writing end, and an inside face of a portion of the distal end portion forming a bottom horizontal bar of the U-shape that curves along the axial direction in the vicinity of the distal writing end, and follows a profile of a conical type having a radius that varies along the axial direction.

* * * * *